US008826663B2

(12) United States Patent
Irmler

(10) Patent No.: US 8,826,663 B2
(45) Date of Patent: Sep. 9, 2014

(54) HEAT EXCHANGER

(71) Applicant: Behr GmbH & Co. KG, Stuttgart (DE)

(72) Inventor: Klaus Irmler, Tuebingen (DE)

(73) Assignee: Behr GmbH & Co. KG, Stuttgart (DE)

( * ) Notice: Subject to any disclaimer, the term of this patent is extended or adjusted under 35 U.S.C. 154(b) by 0 days.

(21) Appl. No.: 13/858,458

(22) Filed: Apr. 8, 2013

(65) Prior Publication Data

US 2013/0219880 A1 Aug. 29, 2013

Related U.S. Application Data

(63) Continuation of application No. PCT/EP2011/067515, filed on Oct. 6, 2011.

(30) Foreign Application Priority Data

Oct. 6, 2010 (DE) ..... 10 2010 042 068

(51) Int. Cl.

| | |
|---|---|
| ***F01K 23/10*** | (2006.01) |
| ***F28F 3/08*** | (2006.01) |
| ***F01K 23/06*** | (2006.01) |
| ***F01K 7/16*** | (2006.01) |
| ***F28D 7/00*** | (2006.01) |
| ***F28D 9/00*** | (2006.01) |
| *F28D 21/00* | (2006.01) |

(52) U.S. Cl.

CPC ..... *F28F 3/08* (2013.01); *F01K 23/065* (2013.01); *F01K 7/16* (2013.01); *F28D 7/0025* (2013.01); *F28D 9/0043* (2013.01); *F28D 21/0003* (2013.01); *F28D 2021/0085* (2013.01); *F28F 2265/26* (2013.01)

USPC ..... 60/618; 60/670; 165/167

(58) Field of Classification Search

CPC ..... F28D 7/0025; F28D 9/0043; F28D 2021/0085; F28D 21/0003; F28F 3/08; F28F 2265/26; F01K 7/16; F01K 23/065

USPC ..... 165/104.25, 166–167; 60/618, 670

See application file for complete search history.

(56) References Cited

U.S. PATENT DOCUMENTS

| | | | | |
|---|---|---|---|---|
| 4,589,265 | A * | 5/1986 | Nozawa | 62/526 |
| 5,095,972 | A * | 3/1992 | Nakaguro | 165/153 |
| 5,927,396 | A | 7/1999 | Damsohn et al. | |
| 6,260,612 | B1 | 7/2001 | Nakamura et al. | |

(Continued)

FOREIGN PATENT DOCUMENTS

| | | |
|---|---|---|
| DE | 34 08 867 A1 | 9/1985 |
| DE | 195 36 115 A1 | 4/1997 |

(Continued)

*Primary Examiner* — Hoang Nguyen

(74) *Attorney, Agent, or Firm* — Muncy, Geissler, Olds & Lowe, P.C.

(57) ABSTRACT

A heat exchanger is provided that includes plate pairs stacked one above the other. A first flow chamber is formed between the two plates of a plate pair by conducting a first fluid therethrough, a second flow chamber for conducting a second fluid therethrough, wherein the second flow chamber is formed between two adjacent plate pairs, an inlet opening for introducing the first fluid, and an outlet opening for discharging the first fluid. The plates have at least one expansion opening, in particular at least one expansion slit, for reducing stress in the plates. The heat exchanger can withstand high thermal and mechanical loads even over a long time period, such as 10 years.

12 Claims, 6 Drawing Sheets

(56) References Cited

U.S. PATENT DOCUMENTS

| | | | | |
|---|---|---|---|---|
| 7,367,387 | B2 * | 5/2008 | Brunner et al. | 165/173 |
| 7,628,199 | B2 * | 12/2009 | Rothenhofer et al. | 165/146 |
| 8,307,651 | B2 | 11/2012 | Hoetger et al. | |
| 2004/0003916 | A1 | 1/2004 | Nash et al. | |
| 2004/0159424 | A1 | 8/2004 | Reinke et al. | |
| 2008/0087411 | A1 | 4/2008 | Richter | |
| 2010/0258095 | A1 | 10/2010 | Saumweber et al. | |
| 2010/0319887 | A1 | 12/2010 | Diem et al. | |
| 2012/0060502 | A1 | 3/2012 | Gärtner et al. | |

FOREIGN PATENT DOCUMENTS

| | | | |
|---|---|---|---|
| DE | 10 2005 002 063 | A1 | 7/2006 |
| DE | 10 2007 033 611 | A1 | 1/2009 |
| DE | 10 2008 057 202 | A1 | 5/2010 |
| DE | 10 2009 012 784 | A1 | 9/2010 |
| EP | 0 217 121 | A1 | 4/1987 |
| EP | 1 189 009 | A1 | 3/2002 |
| WO | WO 90/13394 | | 11/1990 |
| WO | WO 2009/089885 | A1 | 7/2009 |

* cited by examiner

HEAT EXCHANGER

This nonprovisional application is a continuation of International Application No. PCT/EP2011/067515, which was filed on Oct. 6, 2011, and which claims priority to German Patent Application No. DE 10 2010 042 068.9, which was filed in Germany on Oct. 6, 2010, and which are both herein incorporated by reference.

BACKGROUND OF THE INVENTION

1. Field of the Invention

The present invention relates to a heat exchanger, a system for utilizing the waste heat from an internal combustion engine via a Clausius-Rankine cycle process, and an internal combustion engine having a system for utilizing the waste heat of the internal combustion engine by the Clausius-Rankine cycle process.

2. Description of the Background Art

Internal combustion engines are used in various technical applications for converting thermal energy into mechanical energy. In motor vehicles, especially in trucks, internal combustion engines are used to move the motor vehicle. The efficiency of internal combustion engines can be increased by the use of systems for utilizing the waste heat from the internal combustion engine by means of the Clausius-Rankine cycle process. In this process, the system converts the waste heat from the internal combustion engine into mechanical energy. The system comprises a circuit having lines with a working medium, e.g., water or an organic refrigerant such as R245fa, a pump for conveying the working medium, an evaporator heat exchanger for vaporizing the liquid working medium, an expander, a condenser for liquefying the vaporous working medium, and a collecting and equalizing tank for the liquid working medium. The use of systems of this type in an internal combustion engine can increase the overall efficiency of an internal combustion engine in an internal combustion engine with a system of this type as an internal combustion engine component.

In the evaporator heat exchanger, the working medium is vaporized by the waste heat of the internal combustion engine and then the vaporized working medium is supplied to the expander, where the gaseous working medium expands and performs mechanical work by means of the expander. In the evaporator heat exchanger, for example, the working medium is conveyed through a first flow duct and exhaust gas from the internal combustion engine through a second exhaust gas flow duct. As a result, the heat is transferred from the exhaust gas with a temperature in the range between 400° and 600° C. to the working medium in the evaporator heat exchanger and thereby the working medium is converted from the liquid state to the vapor state.

WO 2009/089885 A1, which corresponds to US 20100319887, which is incorporated herein by reference, shows a device for exchanging heat between a first and a second medium, having plate pairs stacked one on top of another in a stacking direction, whereby a first flow space, through which a first medium can flow, is formed between the two plates of at least one plate pair and a second flow space, through which a second medium can flow, is formed between two plate pairs, adjacent to one another, whereby the first flow space has a first flow path for the first medium with flow path sections which can be flown through one after the other in opposite directions and are separated from one another by a partition wall arranged between the at least two plates of the at least one plate pair.

In an evaporator heat exchanger in a plate/sandwich structure, spacers are arranged between the plate pairs. In this regard, high temperature changes occur in the evaporator heat exchanger during operation of a system for utilizing the waste heat of an internal combustion engine. High requirements are imposed on the operating life of the evaporator heat exchanger when used in an internal combustion engine of a truck. The evaporator heat exchanger in this case must stand up to an operating life of more than 10 years or a mileage of the truck of more than 1 million kilometers. High temperatures occur in this regard in the evaporator heat exchanger, because exhaust gas with high temperatures in the range of 600 to 800° C. is introduced into the evaporator heat exchanger, so that temperatures in the range of up to 500 to 800° C. occur in the evaporator heat exchanger. As a result, the evaporator heat exchanger is exposed to high thermal loads. Spacers are arranged between the plate pairs. The spacers and the plate pairs are soldered together, so that as a result high stress occurs between the spacers and the plate pairs (on the plate pairs/spacers), whereby two spacers each are arranged on a side of a plate pair. Such high shear stress leads to leaking and thereby to a limited operating life of the evaporator heat exchanger.

SUMMARY OF THE INVENTION

It is therefore an object of the present invention to provide a heat exchanger, a system for utilizing the waste heat from an internal combustion engine by means of the Clausius-Rankine cycle process, and an internal combustion engine having a system for utilizing the waste heat from the internal combustion engine by means of the Clausius-Rankine cycle process, in which the heat exchanger withstands high thermal and mechanical loads also over a rather long time period, e.g., 10 years or a mileage of a million kilometers for a truck.

In an embodiment, the object is attained with a heat exchanger, comprising plate pairs stacked one above the other, whereby a first flow chamber is formed between the two plates of a plate pair for conducting a first fluid therethrough, a second flow chamber for conducting a second fluid therethrough, whereby the second flow chamber is formed between two adjacent plate pairs, an inlet aperture for introducing the first fluid, an outlet aperture for discharging the first fluid, whereby the plates have at least one expansion opening, in particular at least one expansion slit, for reducing stress in the plates.

In an embodiment, the plates, for example, one or both plates of a plate pair, are provided with at least one expansion opening. The at least one expansion opening has any desired cross section; for example, it is circular, rectangular, square, or ellipsoidal. In particular, the expansion opening is formed slit-shaped as an expansion slit. Owing to the expansion openings in the plates, stress in the plates, resulting from the high thermal loads of the heat exchanger, can be greatly reduced in an advantageous manner, so that only very low shear stress occurs between the plates and the spacers of the heat exchanger. Stress between the plates can be relieved at the expansion openings, because there is a space for accommodating thermally induced changes in plate size at the expansion openings.

In an embodiment, the plates can have an inlet through hole and a spacer with a through hole each is formed between the plate pairs at the inlet through holes, so that an inlet channel for introducing the first fluid into the first flow chamber forms at the inlet through holes and the through holes of spacers.

In an embodiment, the plates can have an outlet through hole and a spacer each with a through hole is formed between the plate pairs at the outlet through holes, so that an outlet channel for discharging the first fluid from the first flow chamber forms at the outlet through holes and the through holes of the spacers.

The at least one expansion opening can be formed in the plates between the inlet through hole and the outlet through hole. The spacers are arranged between the inlet through hole and the outlet through hole in each case between the plate pairs. Thermally induced changes in size or changes in the shape of the plates are especially critical here, because with a change in size or deformation of the plates between the spacers high shear stress must be absorbed to a different extent on the spacers. If, for example, a plate pair is heated much more greatly than a plate pair below it, the more greatly heated plate pair expands much more greatly, so that as a result different changes in the size of the plate pairs occur at the spacers and thereby high shear stress must be absorbed on the spacers. Because of the formation of the at least one expansion opening between the inlet through hole and the outlet through hole, such changes in the shape of plates can be accommodated, so that the arising shear stress on the spacers, i.e., between the plates and the spacers, can be substantially reduced thereby.

In an embodiment, one expansion opening is formed per plate in the area of the inlet through hole and one expansion opening is formed in the area of the outlet through hole.

In another embodiment, the expansion opening is formed in the area of the inlet through hole between the first flow chamber and the inlet through hole and/or the expansion opening is formed in the area of the outlet through hole between the first flow chamber and the outlet through hole.

In an additional embodiments, fins, particularly corrugated fins, and/or at least one tube can be disposed between the plate pairs in the second flow chamber and/or the first flow chamber is formed as a preferably meander-shaped flow channel.

In an embodiment, the components of the heat exchanger, particularly the plates, spacers, and/or fins, can be soldered together and/or the components of the heat exchanger, particularly the plates, spacers, and/or fins, is made at least partially, especially completely, of metal, especially stainless steel. The heat exchanger as an evaporator heat exchanger is exposed thereby to high thermal loads and in the case of passage of exhaust gas through the evaporator heat exchanger also to high chemical loads, so that for the durability of the evaporator heat exchanger it is necessary to form the evaporator heat exchanger of stainless steel, especially in its entirety.

The system of the invention for utilizing the waste heat from an internal combustion engine by means of the Clausius-Rankine cycle process, can include a circuit having lines with a working medium, particularly water, a pump for conveying the working medium, an evaporator heat exchanger for vaporizing the liquid working medium with at least one first flow chamber for conducting the working medium therethrough and at least one second flow chamber for conducting a fluid therethrough, e.g., charge air or exhaust gas, for transferring heat from the fluid to the working medium, an expander, a condenser for liquefying the vaporous working medium, preferably a collecting and equalizing tank for the liquid working medium, whereby the evaporator heat exchanger is configured as a heat exchanger described in this industrial property application.

In another embodiment, the expander can be a turbine or a reciprocating engine.

The heat exchanger can have a plate/sandwich structure and/or can be configured as a plate heat exchanger.

In another embodiment, the system comprises a recuperator, by means of which heat can be transferred from the working medium after flowing through the expander to the working medium upstream of the evaporator.

In an embodiment, the evaporator heat exchanger can be made, at least in part, particularly completely, of stainless steel, because the working medium is conveyed with a high pressure, e.g., in the range between 40 to 80 bar, and the exhaust gas with a high temperature, e.g., in the range of about 600° C., through the evaporator heat exchanger.

An internal combustion engine of the invention, particularly an internal combustion reciprocating piston engine, having a system for utilizing the waste heat from the internal combustion engine by means of the Clausius-Rankine cycle process, the system comprising a circuit having lines with a working medium, particularly water, a pump for conveying the working medium, an evaporator, heatable by the waste heat of the internal combustion engine, for vaporizing the liquid working medium, an expander, a condenser for liquefying the vaporous working medium, preferably a collecting and equalizing tank for the liquid working medium, whereby the evaporator heat exchanger is configured as a heat exchanger described in this industrial property application and/or the fluid conducted through the second flow channel is charge air, so that the evaporator heat exchanger is a charge air cooler, or the fluid is exhaust gas, so that the evaporator heat exchanger is preferably an exhaust gas recirculation (EGR) cooler.

In another embodiment, the waste heat from the main exhaust gas flow of the internal combustion engine and/or the waste heat from the EGR and/or the waste heat from the compressed charge air and/or the heat from a coolant of the internal combustion engine can be utilized by the system as a component of the internal combustion engine. Thus, the waste heat from the internal combustion engine is converted to mechanical energy by the system and thereby the efficiency of the internal combustion engine is increased in an advantageous manner.

In another embodiment, the system can include a generator. The generator can be driven by the expander, so that the system can thereby provide electrical power or an electric current.

In another embodiment, water as a pure substance, R245fa, ethanol (pure substance or mixture of ethanol with water), methanol (pure substance or mixture of methanol and water) longer-chain alcohols C5 to C10, longer-chain hydrocarbons C5 (pentane) to C8 (octane), pyridine (pure substance or mixture of pyridine with water), methylpyridine (pure substance or mixture of methylpyridine with water), trifluoroethanol (pure substance or mixture of trifluoroethanol with water), hexafluorobenzene, a water/ammonia solution, and/or a water-ammonia mixture are employed as the working medium of the system.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
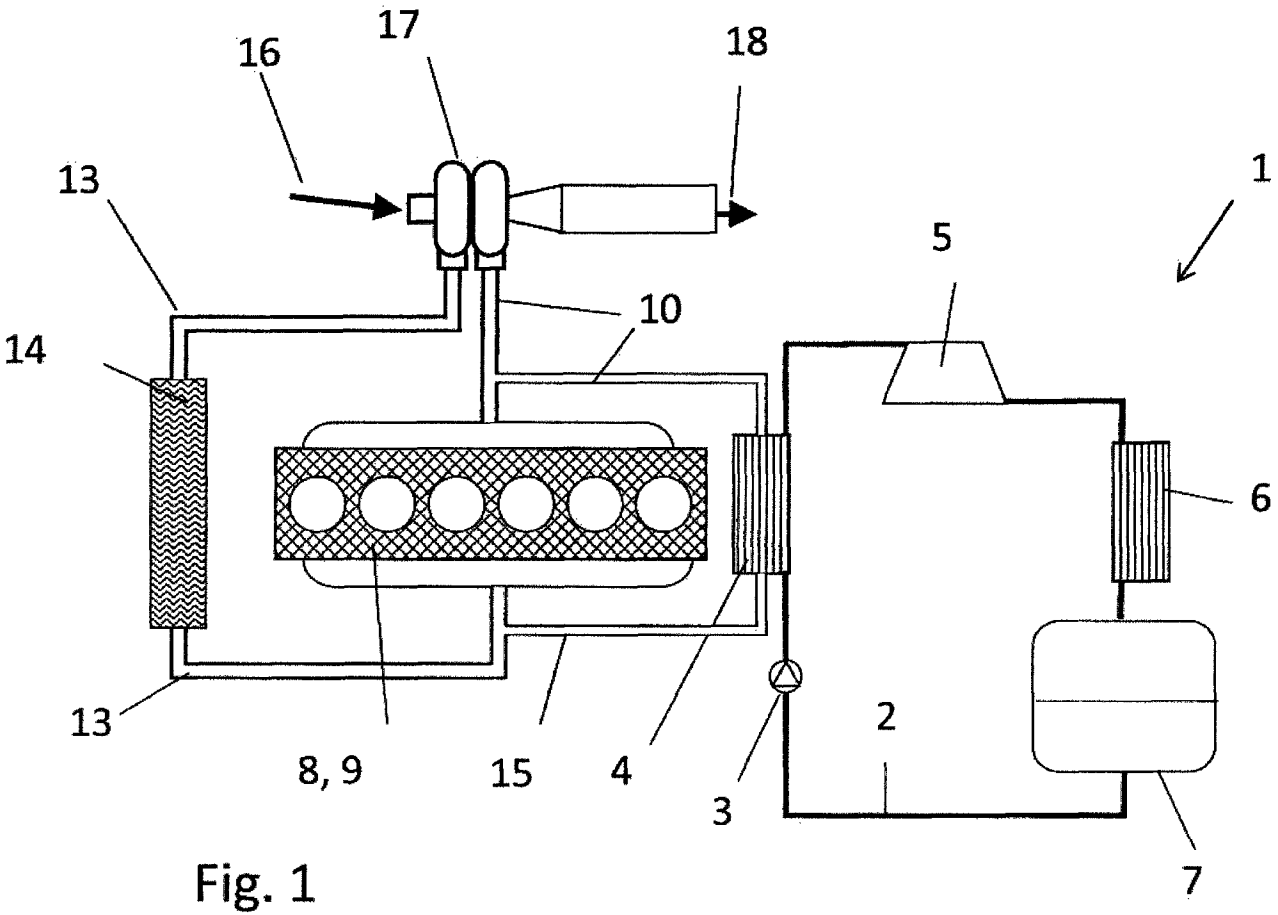
FIG. 1 is a highly simplified illustration of an internal combustion engine with a system for utilizing the waste heat from the internal combustion engine.

An internal combustion engine 8 as an internal combustion reciprocating piston engine 9 is used to drive a motor vehicle, particularly a truck, and comprises a system 1 for utilizing waste heat from the internal combustion engine 8 by means of the Clausius-Rankine cycle process. Internal combustion engine 8 has an exhaust turbocharger 17. Exhaust turbocharger 17 compresses fresh air 16 in a charge air line 13 and a charge air cooler 14, built into charge air line 13, cools the charge air before it is supplied to internal combustion engine 8. A portion of the exhaust gas is conducted away from internal combustion engine 8 through an exhaust gas line 10 and then cooled in an evaporator heat exchanger 4 or heat exchanger 12 as an EGR cooler and with an EGR line 15 combined with the fresh air supplied to internal combustion engine 8 with charge air line 13. Another portion of the exhaust gas is introduced into exhaust turbocharger 17, in order to drive exhaust turbocharger 17 and then released into the environment as exhaust gas 18. System 1 has lines 2 with a working medium. An expander 5, a condenser 6, a collecting and equalizing tank 7, and a pump 3 are integrated into the circuit with the working medium. The liquid working medium is raised to a higher pressure level in the circuit by pump 3 and then the liquid working medium vaporizes in the evaporator heat exchanger 4 and then performs mechanical work in expander 5 in that the gaseous working medium expands and thereupon has a low pressure. The gaseous working medium is liquefied in condenser 6 and then again supplied to collecting and equalizing tank 7.

Figure 2:
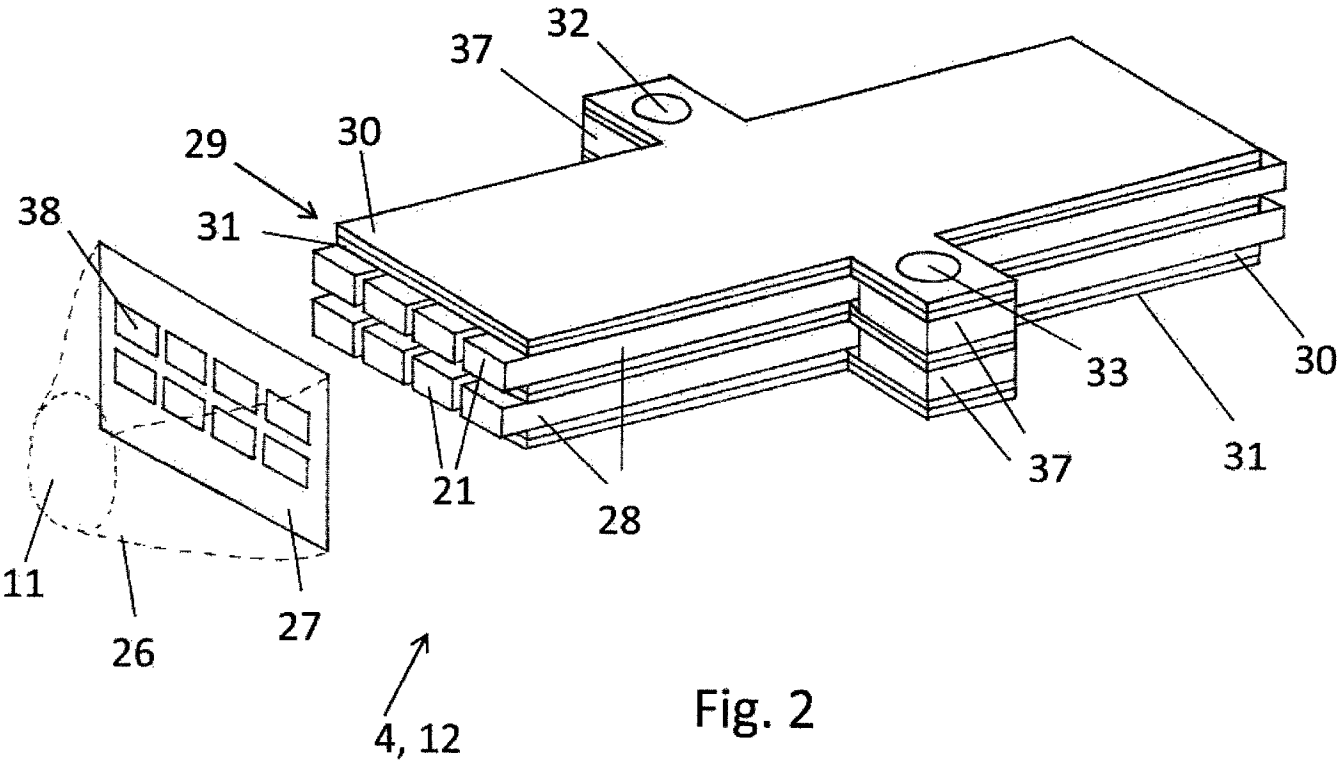
FIG. 2 is a view of an evaporator heat exchanger in a first exemplary embodiment.

A first exemplary embodiment of evaporator heat exchanger 4 or heat exchanger 12 is illustrated in FIG. 2. Evaporator heat exchanger 4 has an inlet aperture 32 for introducing the working medium and an outlet aperture 33 for discharging the working medium from evaporator heat exchanger 4. A first flow chamber 19, not shown in FIG. 2, forms between a plurality of plate pairs 29. Plate pairs 29 each have a top plate 30 and a bottom plate 31. Spacers 37 are disposed in each case between plate pairs 29. In this regard, a meander-shaped flow channel 20 (FIG. 5) is worked into bottom plate 30, so that the meander-shaped flow channel 20 forms between the top and bottom plates 30, 31, said channel through which the working medium is conducted from inlet aperture 32 to outlet aperture 33. The top and bottom plates 30, 31 are thereby connected by means of a material connection, namely a solder joint (not shown). The top and bottom plates 30, 31 further have a through hole 36 in each case at the inlet and outlet aperture 32, 33 (an inlet through hole 36 at inlet aperture 32 and an outlet through hole 36 at outlet aperture 33) and spacers 37 with through holes 25 (FIG. 4) are located at through holes 36 between plate pairs 29, so that thereby the working medium can also flow through plate pairs 29 to the plate pairs 29 lying above and below at spacers 39 (similar to FIG. 4). Spacers 37 as well thereby each have through hole 25 (similar to FIG. 4). Four tubes 28, rectangular in cross section, are disposed between plate pairs 29. Tubes 28, rectangular in cross section, form a second flow chamber 21 for conducting exhaust gas or charge air, so that heat is transferred from the exhaust gas or charge air to the working medium and thereby the working medium is vaporized in evaporator heat exchanger 4.

A base 27 has diffuser openings 38 rectangular in cross section. Base 27 is connected by material bonding to tubes 28 at diffuser openings 38, i.e., is soldered to them. A gas diffuser 26 is disposed at base 27; it is represented only with dashed lines in FIG. 2 and has an inlet aperture 11 for introducing the exhaust gas or charge air. In FIG. 2, base 27 as an exploded illustration is not yet attached to tubes 28. A second base 27 with gas diffuser 26 (not shown) is also disposed in a similar way at the other end of tubes 28, which are shown farther back in FIG. 2. The top and bottom plates 30, 31 are connected together by means of a material connection, i.e., the solder joint (not shown).

Figure 3:
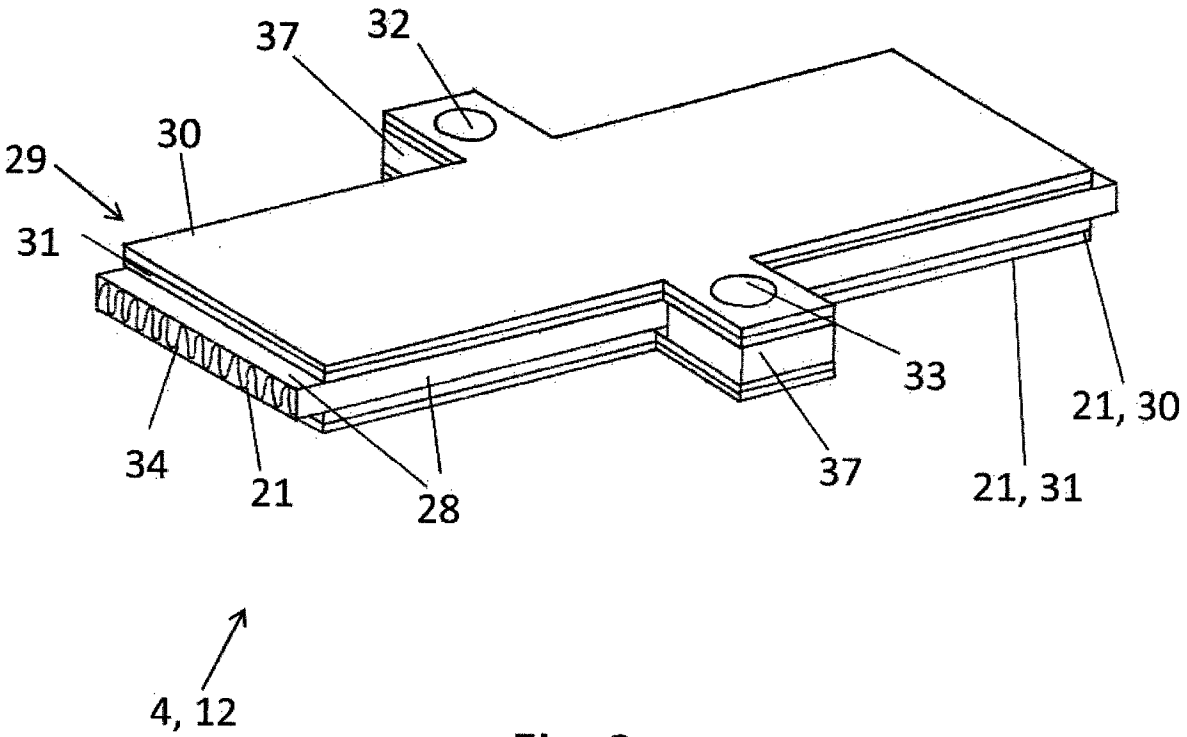
FIG. 3 is a view of the evaporator heat exchanger in a second exemplary embodiment.

A second exemplary embodiment of evaporator heat exchanger 4 is illustrated in FIG. 3. Substantially only the differences with respect to the first exemplary embodiment according to FIG. 2 will be described below. Instead of four tubes 28 rectangular in cross section, only one tube 28, rectangular in cross section, is disposed between plate pairs 29, and a fin 34 or fin structure 34 is disposed within tube 28. Base 27 with diffuser openings 38 and a gas diffuser 26 (not shown) are attached to tubes 28 in a manner similar to the first exemplary embodiment. This applies to both ends of tubes 28 according to the exemplary embodiment in FIG. 3. In this regard, evaporator heat exchanger 4 both in the first and second exemplary embodiment has a plurality of plate pairs 29, arranged one above the other, and tubes 28 arranged between them. This is shown only partially in FIGS. 2 and 3.

Figure 4:
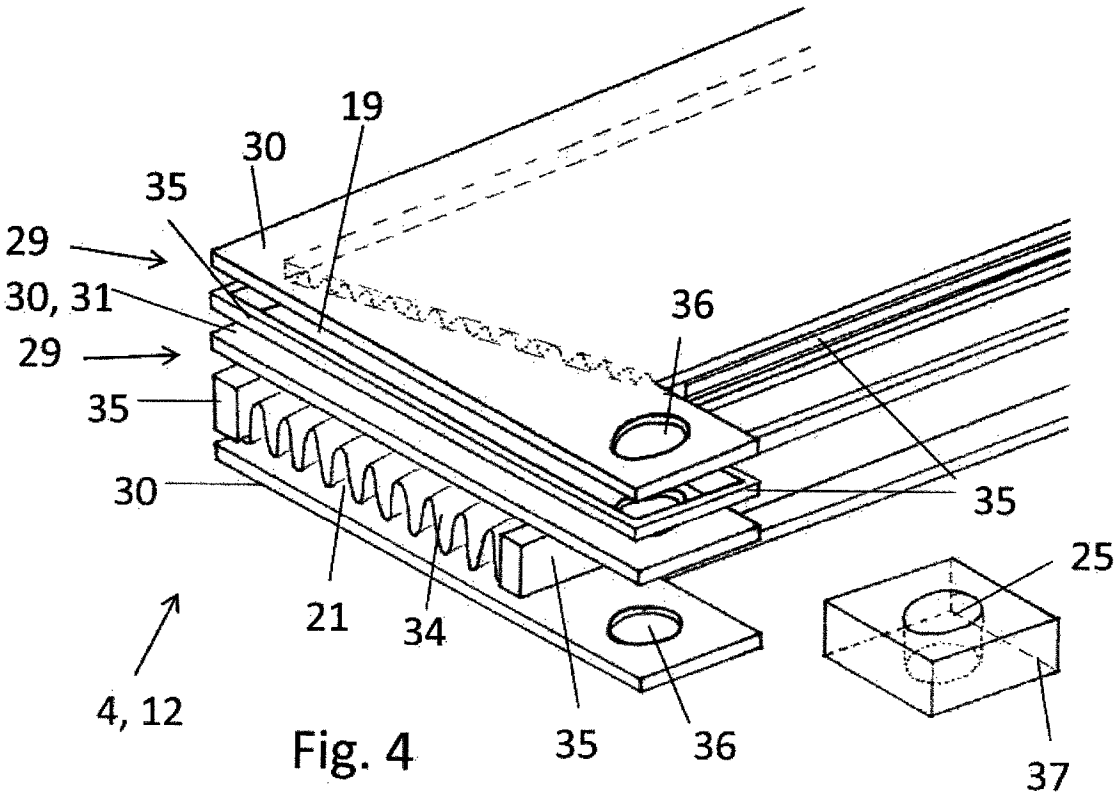
FIG. 4 is a view of the evaporator heat exchanger in a third exemplary embodiment.

A third exemplary embodiment of evaporator heat exchanger 4 is illustrated in FIG. 4. In a manner similar to the second exemplary embodiment according to FIG. 3, a plurality of plate pairs 29 with a top and bottom plate 30, 31 are connected together and arranged one above the other. In so doing, upper plate 30 is connected with bottom plate 31 with the solder joint indirectly with a circumferential frame 35. A first flow chamber 19 forms as a result between the top and bottom plate 30, 31. Spacer 37 with through hole 25 is disposed between plate pairs 29, so that the working medium in a plurality of flow chambers 19 between plates 30, 31 of plate pairs 29, arranged one above the other, can be supplied and discharged because of through holes 36 in the top and bottom plates 30, 31. Fin 34 is disposed between bottom plate 31 and top plate 30 of two different plate pairs 29 and in each case a second flow chamber 21 for the fluid between two plate pairs 29 forms because of frame 35 between said top plate 30 and bottom plate 31. A gas diffuser 26 (not shown) is disposed on the gas-side edge of plate pairs 29. Gas diffuser 38 here is soldered fluid-tight directly to both ends of plate pairs 29 stacked one on top of the other.

The components of evaporator heat exchanger 4, e.g., plate pairs 29, fins 34, gas diffuser 26, or spacer 37, e.g., made of stainless steel or aluminum, are connected together by the material connection, particularly the solder joint or an adhesive joint.

Figure 5:
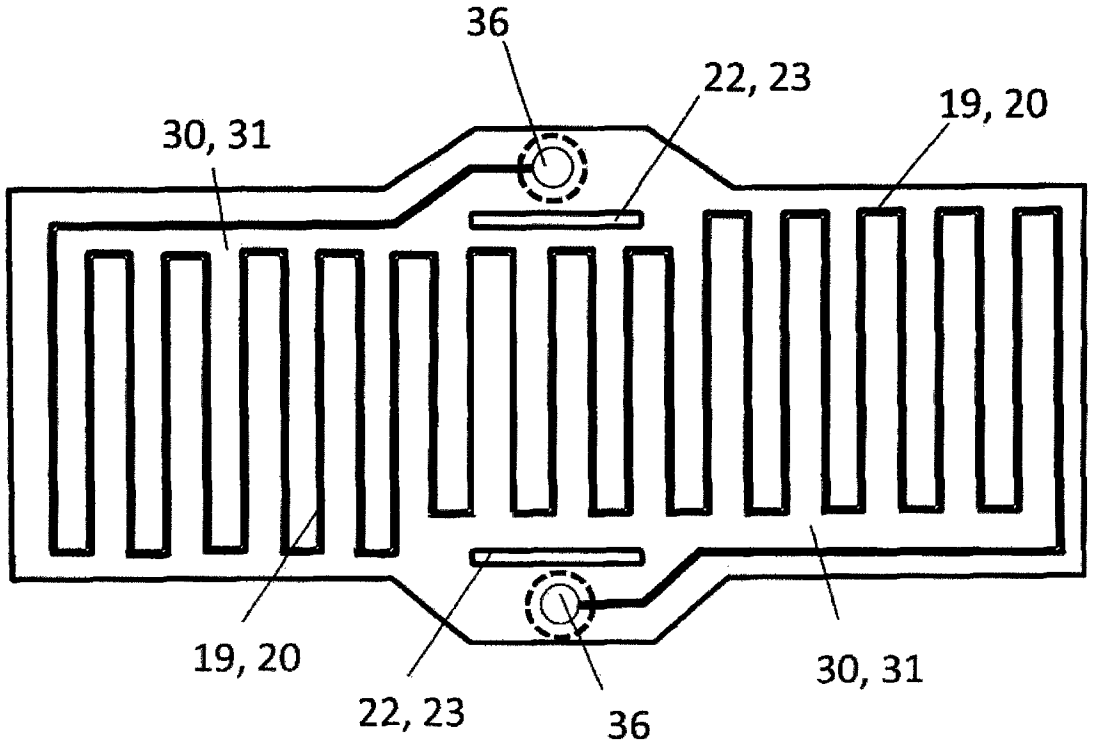
FIG. 5 is a plan view of a plate of the evaporator heat exchanger.

A view of plate 30, 31 of evaporator heat exchanger 4 according to the first and second exemplary embodiment is illustrated in FIG. 5. The top and bottom plates 30, 31 have two through holes 36 for conducting the working medium. In this regard, a flow channel 20 is worked into plate 30, 31 as first flow chamber 19, which connects the two through holes 36 together. As a result, the working medium can flow from the top (inlet) through hole 36 through flow channel 20 to the bottom (outlet) through hole 36 according to FIG. 5. Spacers 37 with through holes 25 are disposed between two plate pairs (FIGS. 2 and 3) in each case at through holes 36. In this case, different temperature changes can arise in plate pairs 29 during the operation of evaporator heat exchanger 4. For example, a plate pair 29 can be heated much more greatly than a plate pair 29 lying below. As a result, plates 30, 31 of the more greatly heated plate pair 29 expand much more greatly, so that as a result shear stress must be absorbed on spacers 37, because plate pair 29, which is heated more greatly, expands more greatly than plate pair 29, which is not heated or heated only slightly. Such shear stress can lead to damage of the solder joint between plates 30, 31 and spacers 37. For this reason, there are two expansion openings 22, each formed as expansion slit 26, between the two through holes 36. Because of the two expansion slits 23, plates 30, 31 can deform slightly with temperature changes, so that as a result only low stress occurs in plates 30, 31 between through holes 36 and thereby only low shear stress occurs at the solder joints also between plates 30, 31 and spacers 37. In this regard, expansion slits 23 are each formed between through holes 36 and flow channel 20. Sufficient solder joints are present between expansion openings 22 and through holes 36 and between expansion openings 22 and flow channel 20, so that evaporator heat exchanger 4 also continues to withstand high mechanical stress, particularly due to vibrations. Expansion slits 23 thereby have a width in the range of 1 to 10 mm, preferably between 2 and 5 mm, and a length in the range of 2 to 30 mm, preferably in the range between 5 and 30 mm.

In the case of heat exchanger 4 according to the third exemplary embodiment in FIG. 4, bottom plate 31 does not have a meander-shaped flow channel 20, but plates 30, 31 are each provided with two expansion slits 23 as in FIG. 5.

Figure 6:
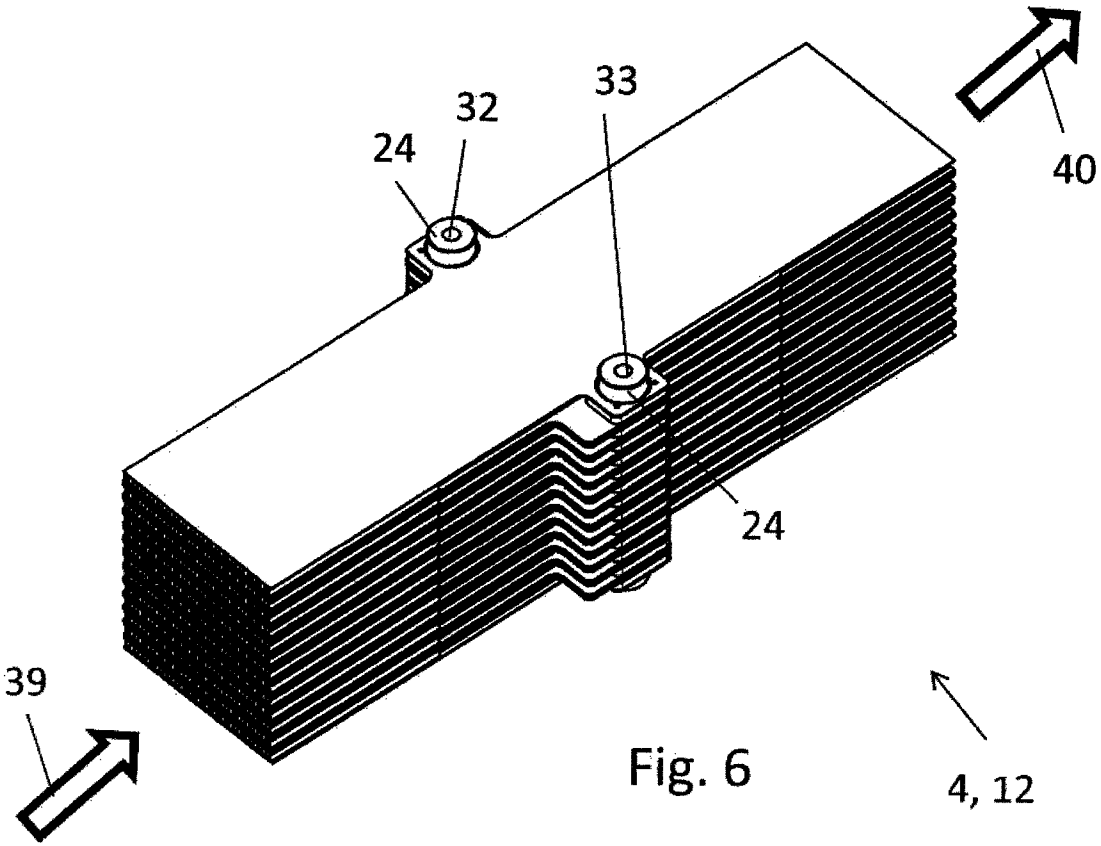
FIG. 6 is a perspective view of the evaporator heat exchanger.

A perspective view of evaporator heat exchanger 4 as heat exchanger 12 is illustrated in FIG. 6. A connector 24 is disposed at the two through holes 36 of the topmost plate 30. An inlet aperture 32 for the working medium and an outlet aperture 33 for the working medium are present in connector 24. The exhaust gas is conducted through second flow chamber 21, formed between plate pairs 29. Thus, the exhaust gas is introduced through an inlet 39 and discharged through an outlet 30 from heat exchanger 12. Preferably, evaporator heat exchanger 4, particularly heat exchanger 12, can have a housing, which is also not shown, and plate pairs 29, stacked one above the other, are disposed within the interior space enclosed by the housing. The housing here has inlet aperture 11 for the second fluid, namely, the exhaust gas, and an outlet aperture. The housing here can also be formed as gas diffuser 26.

Regarded overall, major advantages are associated with heat exchanger 12 of the invention. During use of heat exchanger 12 as an evaporator heat exchanger 4, high thermal loads occur in system 1 due to temperature changes in evaporator heat exchanger 4. Because of expansion openings 22 in plates 30, 31, the arising thermal stress is greatly reduced, so that as a result the operating life of evaporator heat exchanger 4 is greatly increased, because much lower shear stress or forces must be absorbed by the solder joints between plates 30, 31 and spacers 37.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger comprising:

plate pairs stacked one above the other, a first flow chamber formed between two plates of a plate pair such that a first fluid is adapted to flow therethrough;

a second flow chamber adapted to have a second fluid flow therethrough, the second flow chamber being formed between two adjacent plate pairs;

an inlet aperture for introducing the first fluid;

an outlet aperture for discharging the first fluid; and expansion openings formed in the plates such that stress is reduced in the plates, wherein each plate of the plate pairs has a first expansion opening formed in an area of an inlet through hole and a second expansion opening formed in an area of an outlet through hole.

2. The heat exchanger according to claim 1, wherein the plates have a spacer, each with a through hole formed between the plate pairs at the inlet through holes so that an inlet channel for introducing the first fluid into the first flow chamber forms at the inlet through holes and the through holes of the spacers.

3. The heat exchanger according to claim 1, wherein the plates have a spacer, each with a through hole formed between the plate pairs at the outlet through holes so that an outlet channel for discharging the first fluid from the first flow chamber forms at the outlet through holes and the through holes of the spacers.

4. The heat exchanger according to claim 1, wherein the first and second expansion openings are formed in the plates between the inlet through hole and the outlet through hole.

5. The heat exchanger according to claim, wherein the first expansion opening is formed in an area of the inlet through hole between the first flow chamber and the inlet through hole and the second expansion opening is formed in an area of the outlet through hole between the first flow chamber and the outlet through hole.

6. The heat exchanger according to claim 1, wherein fins, corrugated fins, and/or at least one tube are disposed between the plate pairs in the second flow chamber.

7. The heat exchanger according to claim 1, wherein components of the heat exchanger, the plates, spacers, and/or fins are soldered together and/or the components of the heat exchanger, the plates, spacers, and/or fins are formed partially or completely of metal or stainless steel.

8. A system for utilizing waste heat from an internal combustion engine by a Clausius-Rankine cycle process, the system comprising:

a circuit having lines with a working medium, particularly water;

a pump for conveying the working medium;

an evaporator heat exchanger for vaporizing the liquid working medium with at least one first flow chamber for conducting the working medium therethrough and at least one second flow chamber for conducting a fluid, charge air, or exhaust gas therethrough for transferring heat from the fluid to the working medium;

an expander;

a condenser for liquefying the vaporous working medium; and a collecting and equalizing tank for the liquid working medium, wherein the evaporator heat exchanger is the heat exchanger according to claim 1.

9. An internal combustion engine, particularly an internal combustion reciprocating piston engine, comprising a system for utilizing waste heat from the internal combustion engine by the Clausius-Rankine cycle process, the system comprising:

a circuit having lines with a working medium, particularly water;

a pump for conveying the working medium;

an evaporator heat exchanger, heatable by the waste heat from the internal combustion engine for vaporizing the liquid working medium;

an expander;

a condenser for liquefying the vaporous working medium; and a collecting and equalizing tank for the liquid working medium, wherein the evaporator heat exchanger is the heat exchanger according to claim 1.

10. The heat exchanger according to claim 1, wherein the first and second expansion openings are expansion slits.

11. The heat exchanger according to claim 1, wherein the first flow chamber is formed as a meander-shaped flow channel.

12. The heat exchanger according to claim 1, wherein the first flow chamber is positioned between the first and second expansion openings.

* * * * *